US007895865B2

(12) United States Patent
Hartman et al.

(10) Patent No.: US 7,895,865 B2
(45) Date of Patent: Mar. 1, 2011

(54) CYLINDER LOCK ASSEMBLY WITH A TAILPIECE ROTATIONALLY COUPLED TO THE CYLINDER PLUG

(75) Inventors: Glenn Hartman, Salem, VA (US); Mark Benzie, Roanoke, VA (US); Dan Boadwine, Salem, VA (US); Clyde T. Roberson, Salem, VA (US); Doug Trent, Roanoke, VA (US); Peter H. Field, Salem, VA (US)

(73) Assignee: Medeco Security Locks, Inc., Salem, VA (US)

( * ) Notice: Subject to any disclaimer, the term of this patent is extended or adjusted under 35 U.S.C. 154(b) by 0 days.

(21) Appl. No.: 12/191,565

(22) Filed: Aug. 14, 2008

(65) Prior Publication Data

US 2009/0044579 A1 Feb. 19, 2009

Related U.S. Application Data

(60) Provisional application No. 60/956,007, filed on Aug. 15, 2007.

(51) Int. Cl.
*E05B 17/04* (2006.01)

(52) U.S. Cl. ..... 70/1.5; 70/372; 70/375; 70/379 R; 70/380; 70/416; 70/493

(58) Field of Classification Search ..... 70/379 R, 70/379 A, 380, DIG. 12, DIG. 62, 1.5, 1.7, 70/416–418, 493, 375, 372, 391, 451
See application file for complete search history.

(56) References Cited

U.S. PATENT DOCUMENTS

| | | | | | |
|---|---|---|---|---|---|
| 464,853 | A | * | 12/1891 | Case et al. | 70/379 R |
| 470,413 | A | * | 3/1892 | Roche | 70/379 R |
| 818,719 | A | * | 4/1906 | Webb | 70/492 |
| 1,564,463 | A | * | 12/1925 | Ellison | 70/380 |
| 1,814,302 | A | * | 7/1931 | Morris | 70/134 |
| 1,835,130 | A | * | 12/1931 | Wread | 70/370 |
| 1,888,954 | A | * | 11/1932 | Keil | 70/367 |
| 2,014,233 | A | * | 9/1935 | Keil | 70/367 |
| 2,660,046 | A | * | 11/1953 | Jacobi | 70/344 |
| 2,948,140 | A | * | 8/1960 | Etsten | 70/216 |
| 3,404,549 | A | * | 10/1968 | Edwin | 70/370 |
| 3,499,302 | A | | 3/1970 | Spain et al. | |
| 3,541,820 | A | * | 11/1970 | Best | 70/369 |
| 3,722,240 | A | | 3/1973 | Spain et al. | |
| 4,068,510 | A | * | 1/1978 | Neary | 70/379 R |
| 4,109,496 | A | * | 8/1978 | Allemann et al. | 70/380 |
| 4,301,667 | A | * | 11/1981 | Best et al. | 70/380 |
| 4,394,821 | A | * | 7/1983 | Best et al. | 70/422 |
| 4,635,455 | A | | 1/1987 | Oliver | |
| 4,663,953 | A | * | 5/1987 | Fish et al. | 70/380 |
| 5,161,397 | A | * | 11/1992 | Raybary | 70/374 |
| 5,193,372 | A | * | 3/1993 | Sieg et al. | 70/369 |
| 5,233,851 | A | * | 8/1993 | Florian | 70/367 |
| 5,269,162 | A | * | 12/1993 | Robida et al. | 70/224 |
| 5,289,709 | A | | 3/1994 | Field | |

(Continued)

*Primary Examiner* — Lloyd A. Gall
(74) *Attorney, Agent, or Firm* — Rothwell, Figg, Ernst & Manbeck PC

(57) ABSTRACT

The present application relates to lock assemblies that provide a secondary coupling point, utilizing an anti-rotation pin or extended tailpiece leg or other method, which rotationally couples the tailpiece to the cylinder plug, thereby preventing rotation of the tailpiece independently of the cylinder plug. Therefore, a tailpiece within a bolt cam or other actuator used to withdraw a bolt or unlock a lockset cannot be rotated after the tailpiece connector connecting the tailpiece to the cylinder plug has been forcibly removed, severed, or destroyed.

23 Claims, 12 Drawing Sheets

U.S. PATENT DOCUMENTS 5,419,168 A 5/1995 Field
5,570,601 A 11/1996 Field
5,615,565 A 4/1997 Field
5,987,946 A * 11/1999 Watts ..... 70/394
6,023,954 A 2/2000 Field
6,109,080 A * 8/2000 Chen et al. ..... 70/371
6,477,875 B2 11/2002 Field et al.
6,644,076 B2 * 11/2003 Huang ..... 70/379 R
6,722,171 B1 * 4/2004 Ruan ..... 70/379 R
6,758,075 B1 * 7/2004 Thwing ..... 70/389
6,883,356 B1 * 4/2005 Wu ..... 70/379 R

* cited by examiner

CYLINDER LOCK ASSEMBLY WITH A TAILPIECE ROTATIONALLY COUPLED TO THE CYLINDER PLUG

PRIORITY

This application claims priority from U.S. Provisional Application No. 60/956,007, filed Aug. 15, 2007, the disclosure of which is hereby incorporated by reference.

BACKGROUND OF THE INVENTION

1. Field of the Invention

The present invention is directed to an improved cylinder lock assembly. In particular, the present invention discloses a cylinder lock assembly that maintains a rotational coupling between a cylinder plug and a tailpiece in the event that the connection between them is forcibly breached.

2. Description of the Related Art

Cylinder lock assemblies are known in the art. In general, a cylinder lock assembly may comprise a cylinder plug and a tailpiece. The tailpiece is normally operatively coupled to a deadbolt, latch or the like on one end and to the cylinder plug on the other end, thereby coupling the cylinder plug to the deadbolt or latch. When the cylinder plug is rotated—e.g., by inserting and turning an appropriate key—it causes the tailpiece to rotate, which then causes a reciprocal retraction or extension of the deadbolt or latch. Typically, the cylinder plug, and therefore the tailpiece, can only rotate when the proper key is inserted into the plug. A problem associated with this kind of lock, however, is that a tailpiece may be made to rotate independantly of a cylinder plug by forcibly disconnecting the without the insertion of the proper key.

FIG. 1 shows a conventional cylinder lock assembly. The lock includes a cylinder plug 10 that is rotatably held within a housing (not shown) and includes a front end 14 and a rear end 12. Exemplary cylinder locks of the type shown are described in the following patents assigned to Medeco Security Locks, Inc.—the respective disclosures of which are hereby incorporated by reference: U.S. Pat. No. 3,499,302 Spain et al (1970) U.S. Pat. No. 3,722,240 Spain et al (1973), U.S. Pat. No. 4,635,455 Oliver (1987), U.S. Pat. No. 5,289,709 Field (1994), U.S. Pat. No. 5,419,168 Field (1995), U.S. Pat. No. 5,570,601 Field (1996), U.S. Pat. No. 5,615,565 Field (1997), U.S. Pat. No. 6,023,954 Field (2000), and U.S. Pat. No. 6,477,875 Field et al. (2002).

As is conventional with cylinder locks of the type shown, cylinder plug 10 may include a plurality of radially arranged tumbler shafts 16 for receiving tumbler pins (not shown). A tailpiece 20 is connected to the rear end 12 of the cylinder plug by means of screws, bolts, or other suitable fasteners 1 extending through fastener holes 22 of a tailpiece retainer (retainer plate) 18 and into a fastener-receiving hole 24 formed in the cylinder plug 10. The cylinder lock is operated by means of a key (not shown) inserted into a keyway opening at the front end 14 of the cylinder plug to thereby rotate the cylinder plug 10 about its longitudinal axis within the housing. Rotation of the cylinder plug 10 causes a corresponding rotation of the tailpiece 20 and tailpiece retainer plate 18. The tailpiece 20 is coupled to a bolt or a door-latching mechanism (e.g., a lockset) in a known manner to cause reciprocal retraction and extension of the bolt or latch due to the rotation of the tailpiece 20.

It has been suggested that the cylinder lock shown in FIG. 1 can be breached by inserting a thin rigid object (e.g., a punch) into the keyway, such that the object extends through the rear end 26 of the keyway and against the retainer plate 18 or the end of the tailpiece 20, and thereafter applying a sharp impact force to the rigid object, thereby shearing or otherwise disabling the fastener(s) 1 connecting the tailpiece retainer plate 18 to the cylinder plug 10. With the tailpiece retainer plate 18 disconnected from the cylinder plug 10, the tailpiece retainer plate 18 and the tailpiece 20 can be rotated independently of the cylinder plug 10. Accordingly, if a narrow tool can be inserted into the keyway to grasp and rotate the tailpiece retainer plate 18 and tailpiece 20, the bolt or door latching mechanism can be retracted without rotating the cylinder plug 10, and thus the lock can be bypassed without a key.

Thus, there is a continued need for new and improved cylinder lock assemblies that prevent the deadbolt or latch from being operated even when the tailpiece has been forcibly disconnected from a cylinder plug.

SUMMARY OF THE INVENTION

A goal of the invention is to improve the security of cylinder locks by enabling such locks to resist attacks, such as by a punch hammered through the keyway of the lock. Accordingly, aspects of the invention are embodied in a cylinder lock assembly constructed and arranged to maintain a rotational coupling between the cylinder plug and the tailpiece in the event the conventional connection between the plug and the tailpiece (e.g. screws, clips, caps, etc.) is forcibly breached. More specifically, aspects of the invention are embodied in a cylinder lock assembly which includes a rotational coupling element for rotationally coupling the tailpiece to the cylinder plug so that the tailpiece cannot rotate about the longitudinal axis of the cylinder plug independently of the cylinder plug when the assembly is installed, for example, in a door, and regardless of whether the tailpiece is normally connected to the cylinder plug.

In the context of the this disclosure, a distinction is made between (a) a "connection" between the tailpiece and the cylinder plug, such as the conventional connection described above in which the tailpiece is fixedly attached to the cylinder plug, and (b) rotational "coupling" provided in accordance with aspects of the present invention whereby, although not fixedly attached to one another, the tail piece and cylinder plug are physically engaged so that the tail piece cannot rotate about the longitudinal axis of the cylinder plug independently of the cylinder plug.

According to one embodiment of the present invention, a cylinder lock assembly includes a cylinder plug that is rotatable about its longitudinal axis, a tailpiece adapted to operatively couple the cylinder plug to a deadbolt or a door latch actuator and configured so as to rotate with the cylinder plug when the tailpiece is connected to the cylinder plug, and a coupling element rotationally coupling the tailpiece to the cylinder plug so as to prevent the tailpiece from rotating about the longitudinal axis of the cylinder plug independently of the cylinder plug when the tailpiece is not conventionally connected to the cylinder plug.

The coupling element may, for example, include one or more anti-rotation legs integrally formed with and extending from the tailpiece into openings formed in the cylinder plug. Alternatively, the coupling element may comprise a structural interface, such as a pin or projection extending from the tailpiece retainer plate. The assembly may include a tailpiece retainer cap as opposed to a retainer plate, and a structural interface rotationally coupling the retainer cap to the cylinder plug may include an anti-rotation pin or other extension projecting from the cylinder plug into an opening formed in the retainer cap or a flattened surface formed on a side of the cylinder plug that engages a mating flattened surface formed in the interior of the retainer cap.

According to another embodiment of the invention, a method is provided for rotationally coupling the tailpiece to the cylinder plug of a cylinder lock assembly comprising the step of providing a coupling element that is fixed with respect to the tailpiece and extends axially into the cylinder plug at a location offset from the longitudinal axis of the cylinder plug.

According to another embodiment of the present invention, a method for modifying a cylinder lock assembly includes securing a pin to the tailpiece retainer plate such that the pin extends in a generally axial direction with respect to the cylinder plug and inserting the pin into an axial hole formed in the cylinder plug at a location offset from the longitudinal axis of the cylinder plug.

BRIEF DESCRIPTION OF THE DRAWINGS

Further applications and advantages of various embodiments of the present invention are discussed below with reference to the following figures.

DETAILED DESCRIPTION OF THE PREFERRED EMBODIMENTS

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

FIGS. 2-10 show various embodiments of a cylinder lock assembly constructed and arranged in accordance with the aspects of the present invention to prevent the tailpiece 20 from rotating about the longitudinal axis of the cylinder plug 10 independently of the cylinder plug 10, while the tailpiece is still engaged with the dead bolt or door latch, should the tailpiece retainer plate 18 (or other means for connecting the tailpiece to the cylinder plug) be disconnected from the cylinder plug 10, for example, as described in the Background above. More generally, the cylinder lock assembly includes a rotational coupling element for coupling the tailpiece to the cylinder plug.

Figure 2:
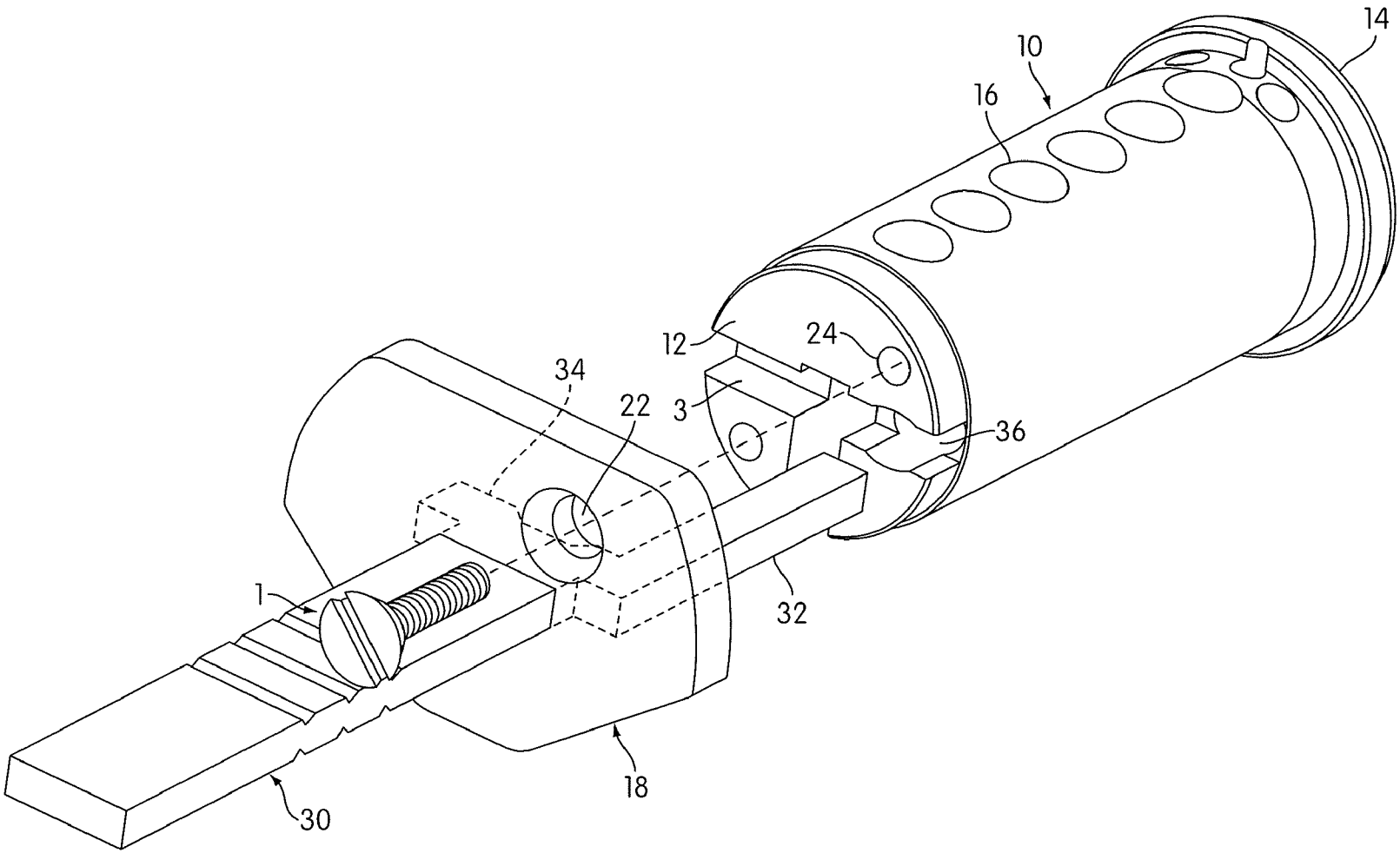
FIG. 2 is an exploded perspective view of a portion of a cylinder lock assembly embodying aspects of the invention including a cylinder plug, a tailpiece with an extended, anti-rotation leg that is insertable into an off-center hole formed in the cylinder plug, a fastener, and a tailpiece retainer plate.
Figure 3:
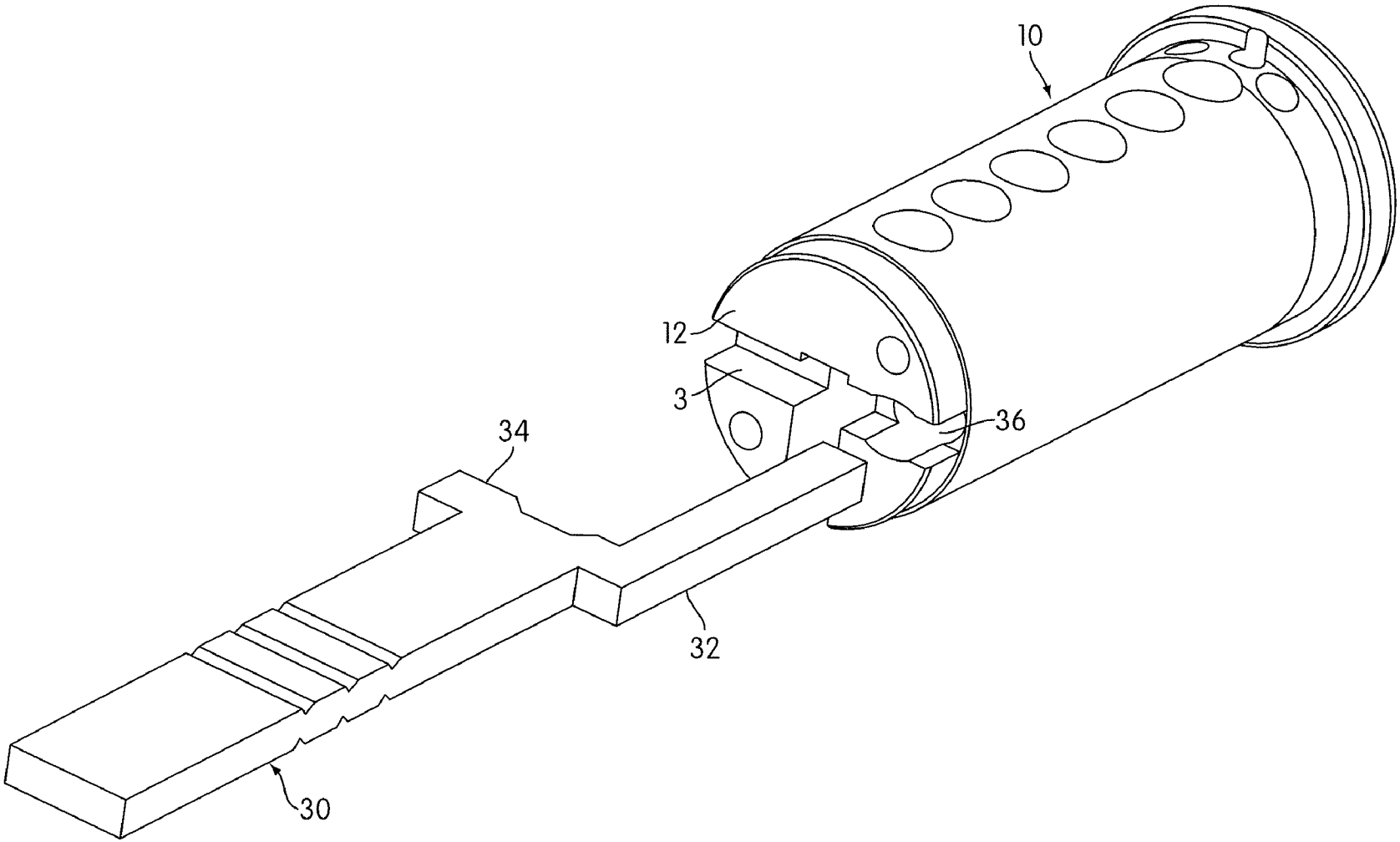
FIG. 3 is an exploded perspective view of the portion of the cylinder lock assembly of FIG. 2 with the tailpiece retainer plate omitted.
Figure 4:
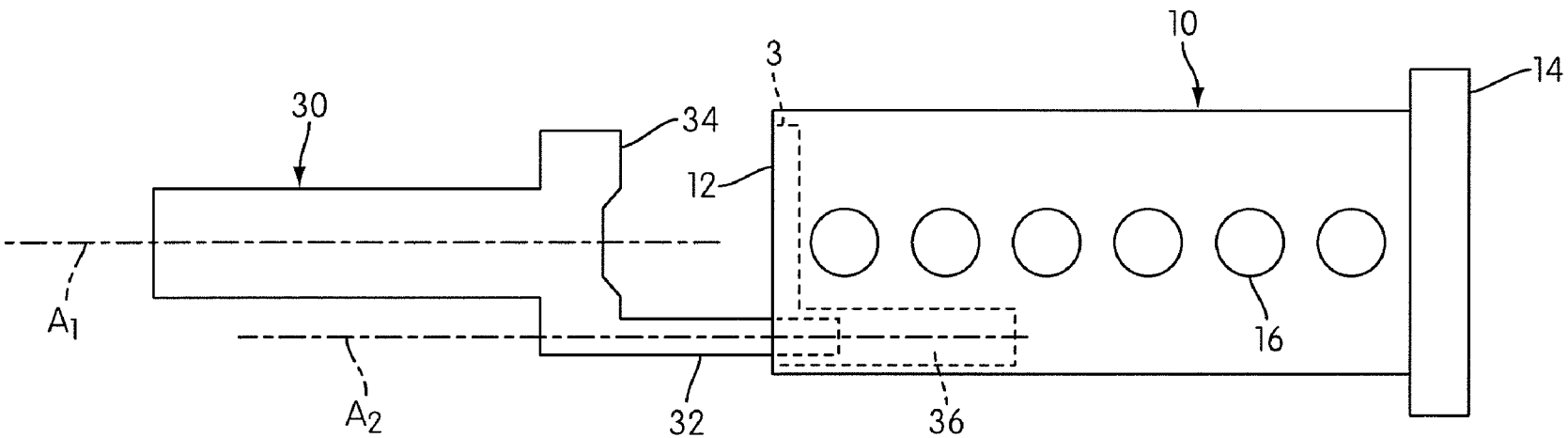
FIG. 4 is top plan view of the portion of the cylinder lock assembly of FIGS. 2 and 3 with the tailpiece retainer plate omitted and the anti-rotation leg partially inserted into an axial hole 36 in the cylinder plug that extends axially toward the front end of the cylinder plug and beyond a tumbler shaft 16 disposed closest to the rear end of the cylinder plug. The anti-rotation leg 32 extends axially toward the front end of the cylinder plug and beyond a tumbler shaft disposed closest to the rear end of the cylinder plug.

In accordance with a first embodiment of the invention shown in FIGS. 2-4, the cylinder lock assembly includes a rotational coupling element in the form of an anti-rotation leg 32 extending from a shoulder 34 of the tailpiece 30. The tailpiece shoulder 34 is configured to engage with the slot 3 in the rear end 12 of the cylinder plug, thereby configuring the tailpiece 30 to rotate with the cylinder plug 10 when the tailpiece is connected to the cylinder plug. The anti-rotation leg 32 extends into an off-center axial hole 36 formed in the cylinder plug 10 and extends axially toward the front end of the cylinder plug and beyond a tumbler shaft disposed closest to the rear end of the cylinder plug. The axial hole 36 is at a location that is offset from the longitudinal axis of the cylinder plug 10. In the illustrated embodiment, axial hole 36 is a round, oblong hole formed in the plug 10 and extends axially toward the front end of the cylinder plug and beyond a tumbler shaft disposed closest to the rear end of the cylinder plug. Alternatively, hole 36 may be circular or rectangular or any other shape that will accommodate the leg 32. Also in the illustrated embodiment, the tailpiece 30, shoulder 34, and anti-rotation leg 32 comprise a single, integrally-formed component. One of ordinary skill in the art, however, would appreciate that the tailpiece 30, shoulder 34, and anti-rotation leg 32 need not comprise a single component and each could, for example, comprise a separate component. Similarly, while the tailpiece 30 and the tailpiece retainer plate 18 are shown as separate components, they could be an integrally-formed, unitary piece. FIG. 3 shows the assembly without the tailpiece retainer plate 18 to avoid obscuring the view of the tailpiece 30.

Should the tailpiece retainer plate 18 be disconnected from the cylinder plug 10 as a result of shearing or otherwise disabling the fastener(s) 1, the tailpiece retainer plate 18, being confined within the structure of the door in which the lock is installed (not shown), cannot be moved in an axial direction sufficiently far away from the cylinder plug 10 to fully withdraw the anti-rotation leg 32 from the off-center hole 36 formed in the plug 10. Accordingly, as shown in FIG. 4, with a portion of the anti-rotation leg 32 inserted into the off-center hole 36 of the cylinder plug 10, and with a portion of the tailpiece 30 engaged with a deadbolt or door latch actuator (not shown), the tailpiece 30 is not able to rotate about the longitudinal axis of the cylinder plug 10 independently of the cylinder plug 10. More specifically, because the axis of rotation A1 of the tailpiece 30 and the cylinder plug 10 (i.e., the longitudinal axis of the cylinder plug 10) is offset from the longitudinal axis A2 of the anti-rotation leg 32, the tailpiece 30 remains rotationally coupled to the cylinder plug 10, even when the tailpiece 30 is disconnected from the end 12 of the cylinder plug 10.

Figure 5:
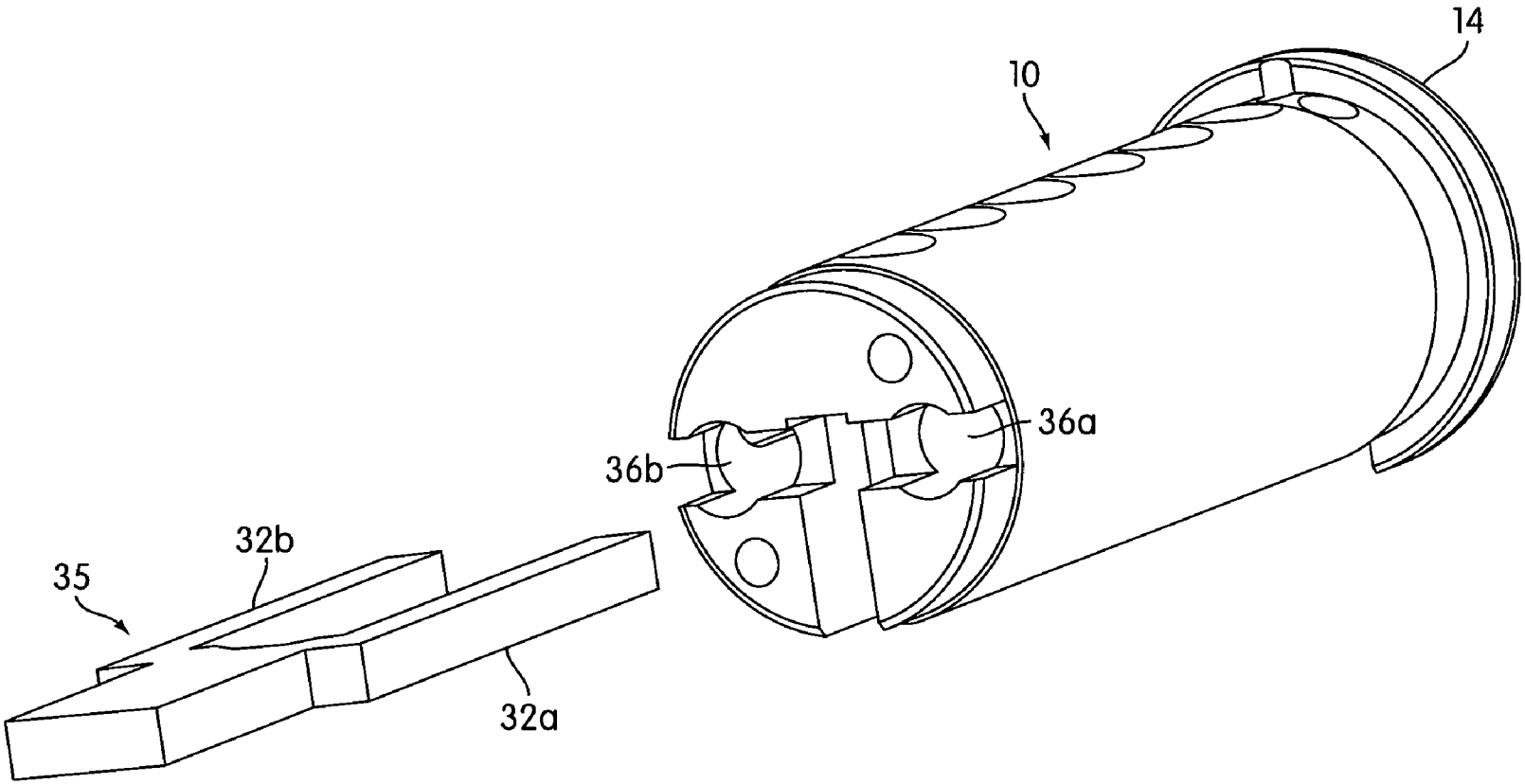
FIG. 5 is an exploded perspective view of a portion of a cylinder lock assembly embodying aspects of the invention including a cylinder plug, a tailpiece with two anti-rotation legs that are insertable into off-center holes formed in the cylinder plug.
Figure 6:
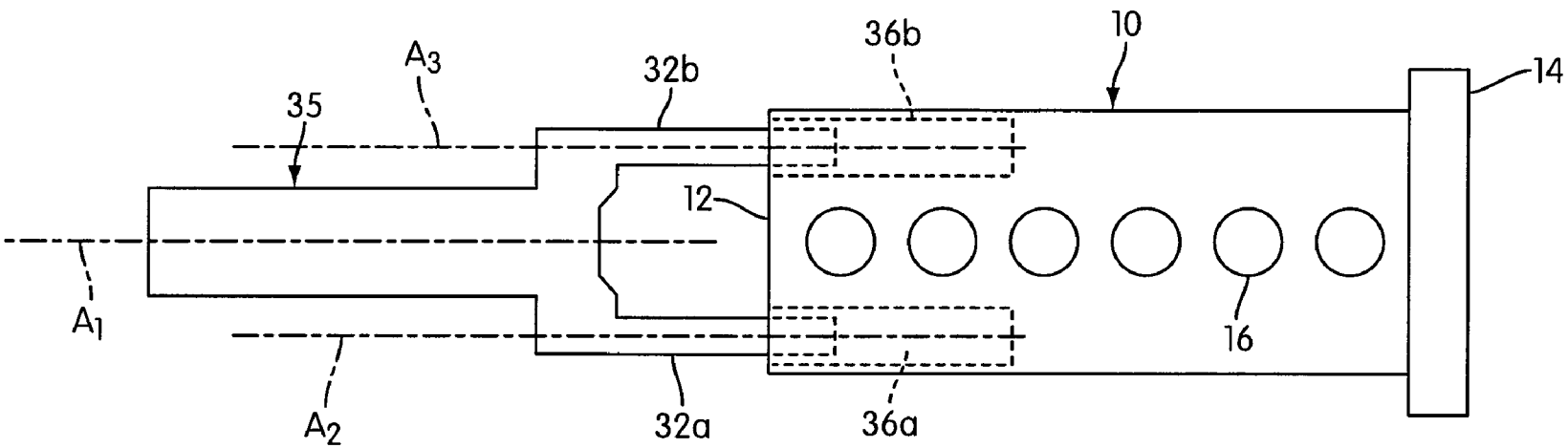
FIG. 6 is top plan view of the portion of the cylinder lock assembly of FIG. 5 with the two anti-rotation legs partially inserted into the cylinder plug.

FIGS. 5 and 6 show an alternative embodiment of the invention. FIG. 5 is an exploded perspective view of a portion of a cylinder lock assembly including a cylinder plug 10, a tailpiece 35 with two anti-rotation legs 32*a*, 32*b* that are insertable into off-center holes 36*a*, 36*b* formed in the cylinder plug 10. In the embodiment of FIG. 5, holes 36*a*, 36*b* are circular, but they could be oblong (as in FIGS. 2 and 3) or rectangular or any other shape that will accommodate the legs 32*a*, 32*b*. FIG. 6 is top plan view of the embodiment of FIG. 5 with the two anti-rotation legs 32*a*, 32*b* extending from the tailpiece 35 and partially inserted into the off-center holes 36*a*, 36*b* formed in the cylinder plug 10. As shown in FIG. 6, with the anti-rotation legs 32*a*, 32*b* inserted into the off-center holes 36*a*, 36*b* of the cylinder plug 10, and with a portion of the tailpiece 35 engaged with a deadbolt or door latch actuator (not shown), the tailpiece 35 is not able to rotate about the longitudinal axis of the cylinder plug 10 independently of the cylinder plug 10. More specifically, because the axis of rotation A1 of the tailpiece 35 and the cylinder plug 10 (i.e., the longitudinal axis of the cylinder plug 10) is offset from the longitudinal axes A2 and A3 of the anti-rotation legs 32*a* and 32*b*, respectively, the tailpiece 35 remains rotationally coupled to the cylinder plug 10, even when the tailpiece 35 is disconnected from the end 12 of the cylinder plug 10.

Figure 7:
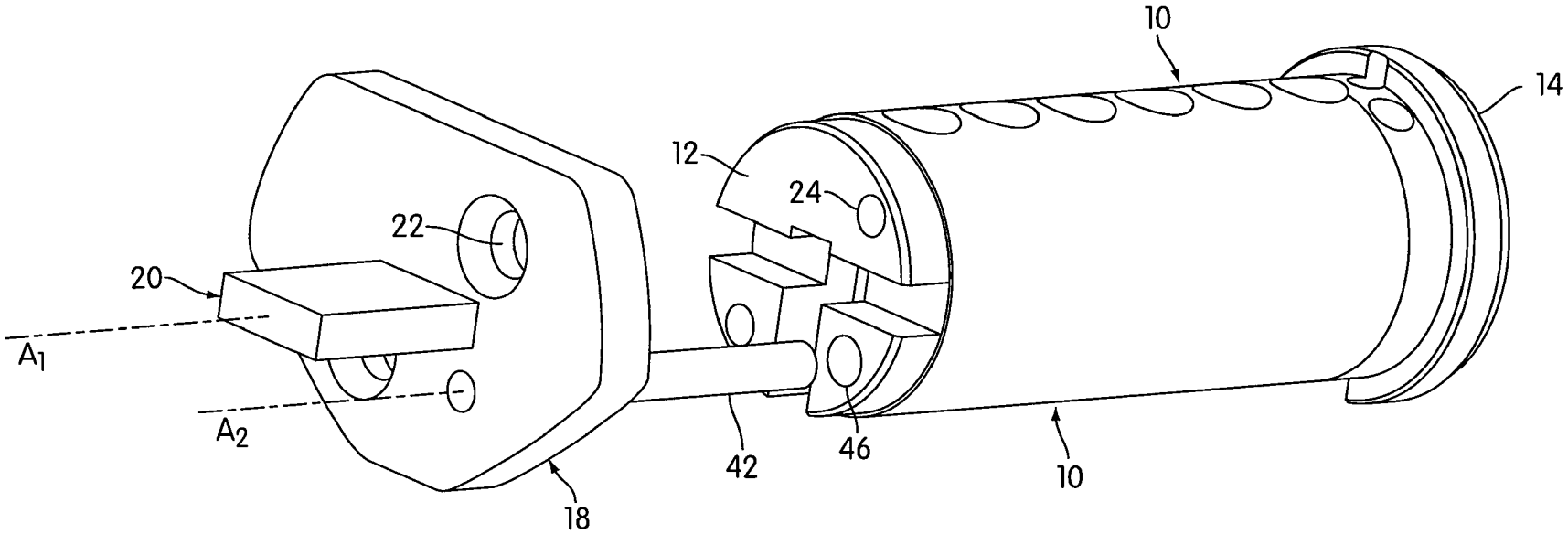
FIG. 7 is an exploded perspective view of a portion of a cylinder lock assembly showing an alternative embodiment of the invention including a cylinder plug, a tailpiece, a tailpiece retainer plate, and an anti-rotation pin extending from the tailpiece retainer plate and insertable into an off-center hole formed in the cylinder plug.

FIG. 7 shows an alternative embodiment of the invention. The embodiment of FIG. 7 includes a tailpiece 20 and tailpiece retainer plate 18, with a rotational coupling element in the form of an anti-rotation pin 42 extending through the tailpiece retainer plate 18 into an off-center axial hole 46 formed in the cylinder plug 10. It would be understood by one of ordinary skill in the art that the tailpiece 20 and the tailpiece retainer plate 18 may comprise separate pieces, as shown here, or a single, integrally formed piece. Thus, the anti-rotation pin 42 provides a structural interface between the retainer plate 18 and the cylinder plug 10 to prevent the tailpiece 20 and the retainer plate 18 from rotating independently of the plug 10 when a portion of the tailpiece 20 is engaged with a deadbolt or door latch actuator (not shown). As with the embodiment described above, even with the tailpiece retainer plate 18 disconnected from the end 12 of the cylinder plug 10, the anti-rotation pin 42 cannot be fully withdrawn from the off-center hole 46, and thus the tailpiece retainer plate 18 and tailpiece 20 remain rotationally coupled to the cylinder plug 10 such that the tailpiece retainer plate 18 and tailpiece 20 cannot rotate independently of the cylinder plug 10.

Figure 1:
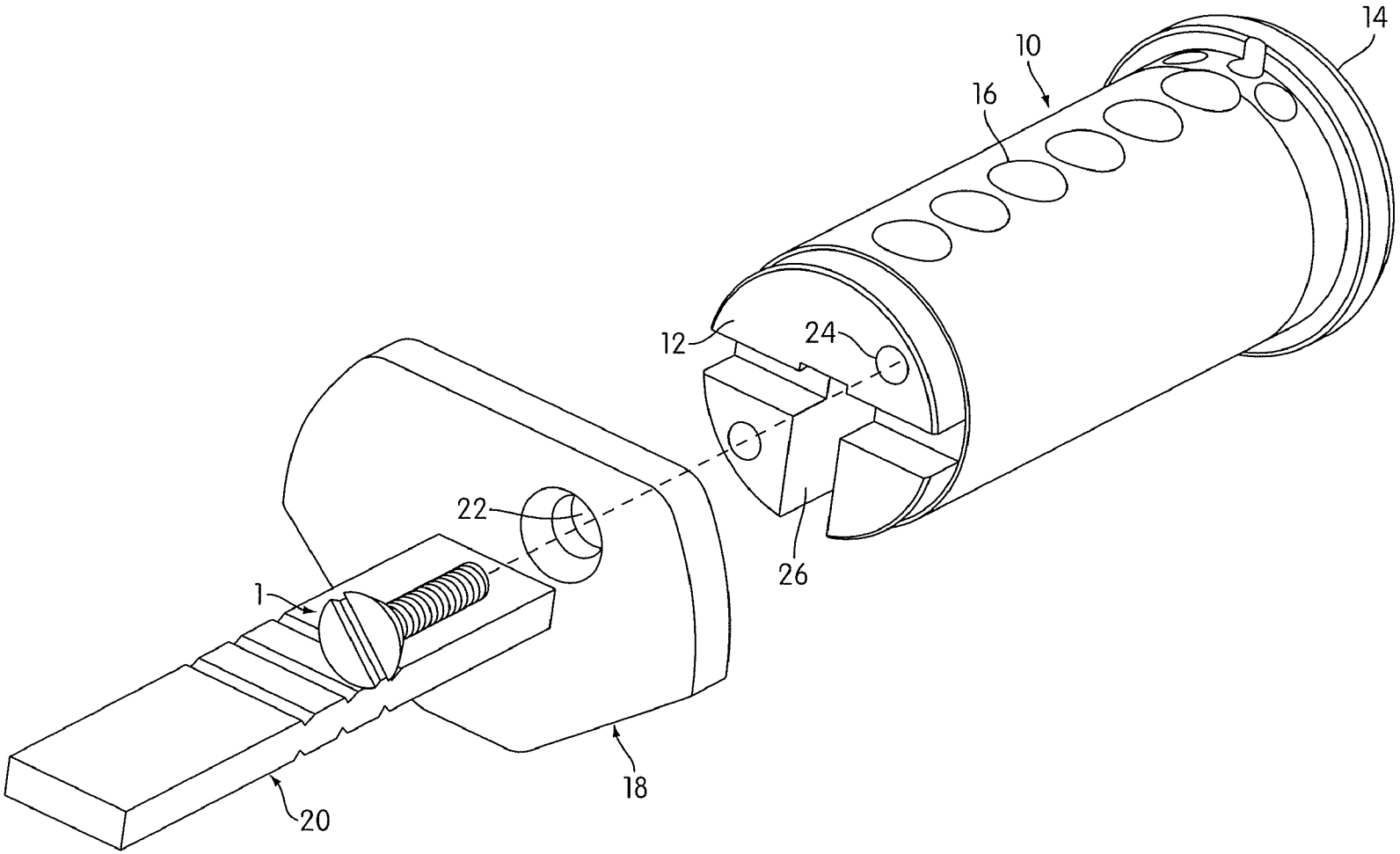
FIG. 1 PRIOR ART
FIG. 1 is an exploded perspective view of a portion of a conventional cylinder lock assembly including a cylinder plug, a tailpiece for coupling the lock to a bolt or door latching mechanism, a fastener, and a tailpiece retainer plate.

Thus, a conventional cylinder-tailpiece assembly, such as shown in FIG. 1, can be modified in accordance with an aspect of the present invention to rotationally couple the tailpiece 20 to the cylinder plug 10 by drilling a hole 46 in the plug 10 at a location that is offset from the longitudinal axis of the cylinder plug, drilling an aligned hole in the tailpiece retainer plate 18, and inserting a pin 42 through the tailpiece retainer plate and into the off-center hole 46.

In an alternative configuration to that shown in FIG. 7, pin 42 may be replaced or assisted by an axially extending projection formed integrally with the tailpiece retainer plate and which can be inserted into a hole or other opening formed in the cylinder plug 10 at a location that is offset from the longitudinal axis of the cylinder plug.

Figure 8:
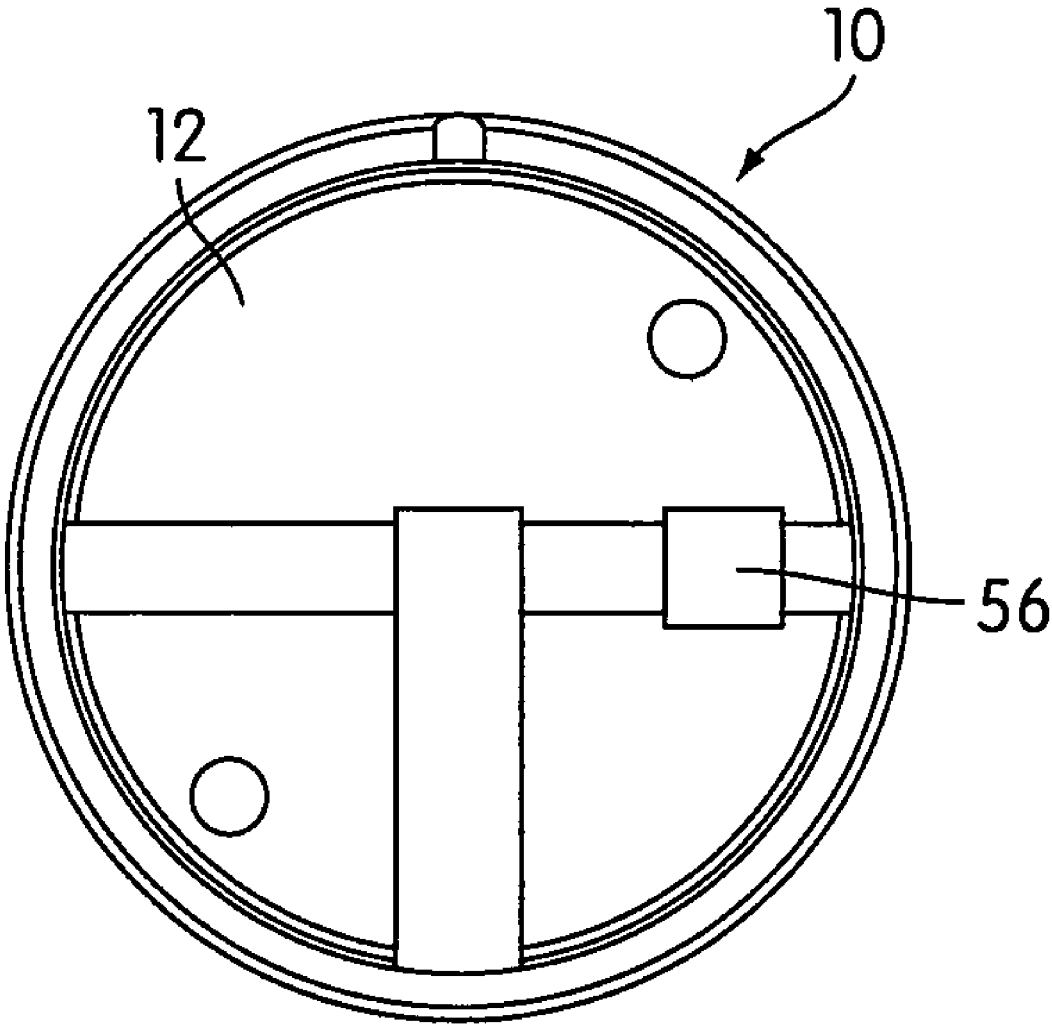
FIG. 8 is an end view of a portion of an alternative embodiment of a cylinder lock assembly in which the off-center hole is in the shape of a rectangle.

FIG. 8 shows an alternative embodiment of the invention. This embodiment differs from others in that the circular or oblong hole 36 formed in the end 12 of the cylinder plug 10 is replaced with a rectangular hole 56. Other shapes such as semicircular, oval, or polygonal—e.g., square, hexagon, octagon, triangle—may be used as well for the shape of the off-center hole 56. Additionally, the hole 56 could be circular for a portion of its axial extent and rectangular or polygonal for a different portion of its extent. The anti-rotation leg 32 can be provided so as to have the same shape as hole 56, in which case, for, e.g., a polygonal or semicircular hole, the leg 32 cannot rotate inside the hole 56 about axis A2. Similarly, an oblong hole that partially matches the shape of the leg, which will also result in the leg not being able to rotate within the hole.

Figure 9:
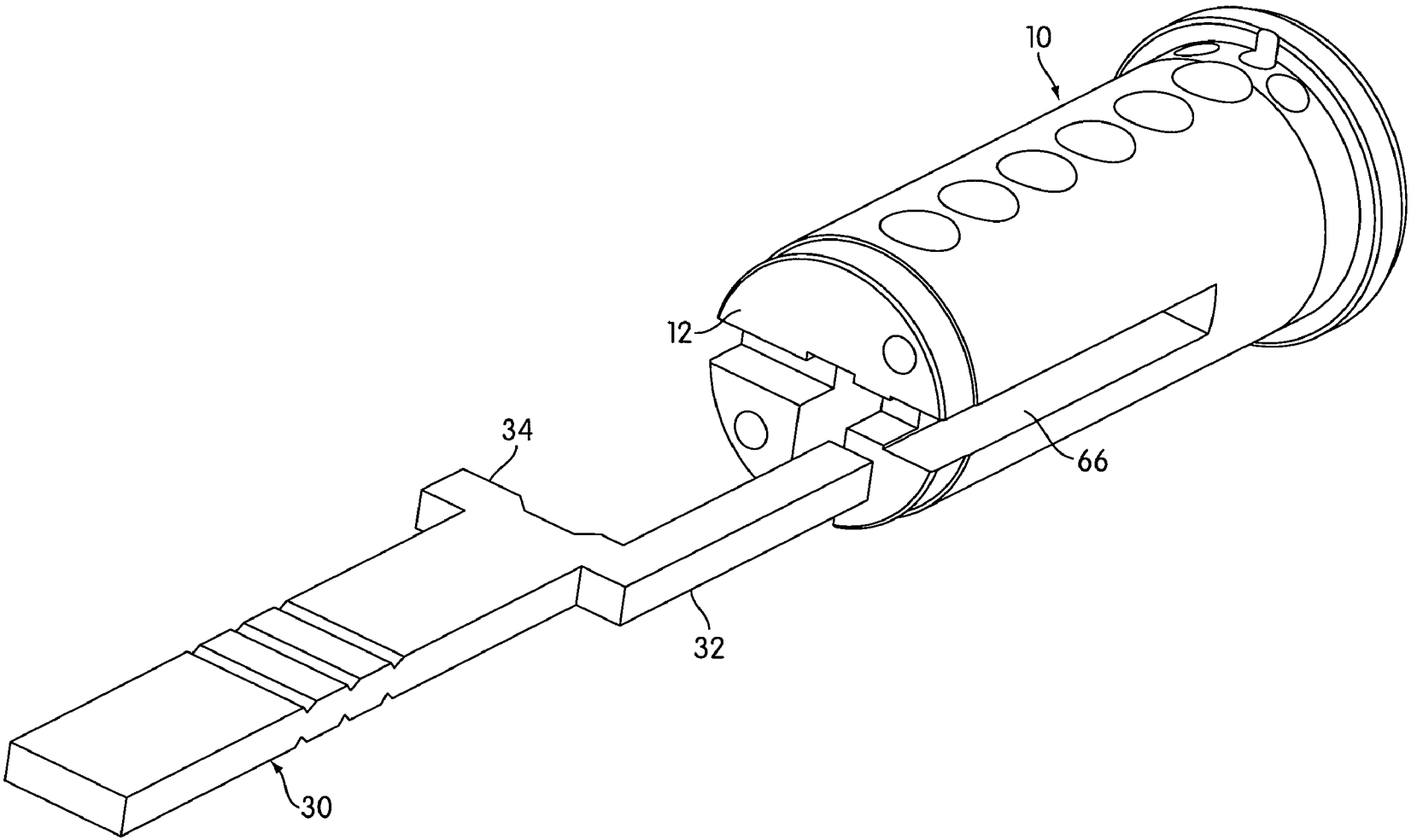
FIG. 9 is an exploded perspective view of a portion of an alternative embodiment of a cylinder lock assembly including a cylinder plug and a tailpiece with an extended, anti-rotation leg that is insertable into an off-center slot formed in the outer surface of cylinder plug.

As is shown in FIG. 9, in a further alternative embodiment, a blind, off-center anti-rotation hole formed into the end of the cylinder plug 10 is replaced by an axially-extending groove 66 formed in the outer surface of the cylinder plug 10. When the anti-rotation leg 32—or an anti-rotation pin 42 or an axial projection extending from the tailpiece retainer plate 18—is positioned inside the groove 66, the tailpiece 20 or 30 cannot rotate about the longitudinal axis of the cylinder plug independently of the cylinder plug. With a rectangular anti-rotation leg, as with anti-rotation leg 32, having the same shape as the groove 66, the anti-rotation leg 32 is unable to rotate within the groove 66, thereby achieving an additional anti-rotation effect. As an alternative to the embodiment shown in FIG. 9, the cylinder plug may have two or more axially-extending grooves formed in the outer surface of the plug, and the tailpiece may have two or more anti-rotation legs, or pins, configured and arranged to extend into the grooves.

Figure 10:
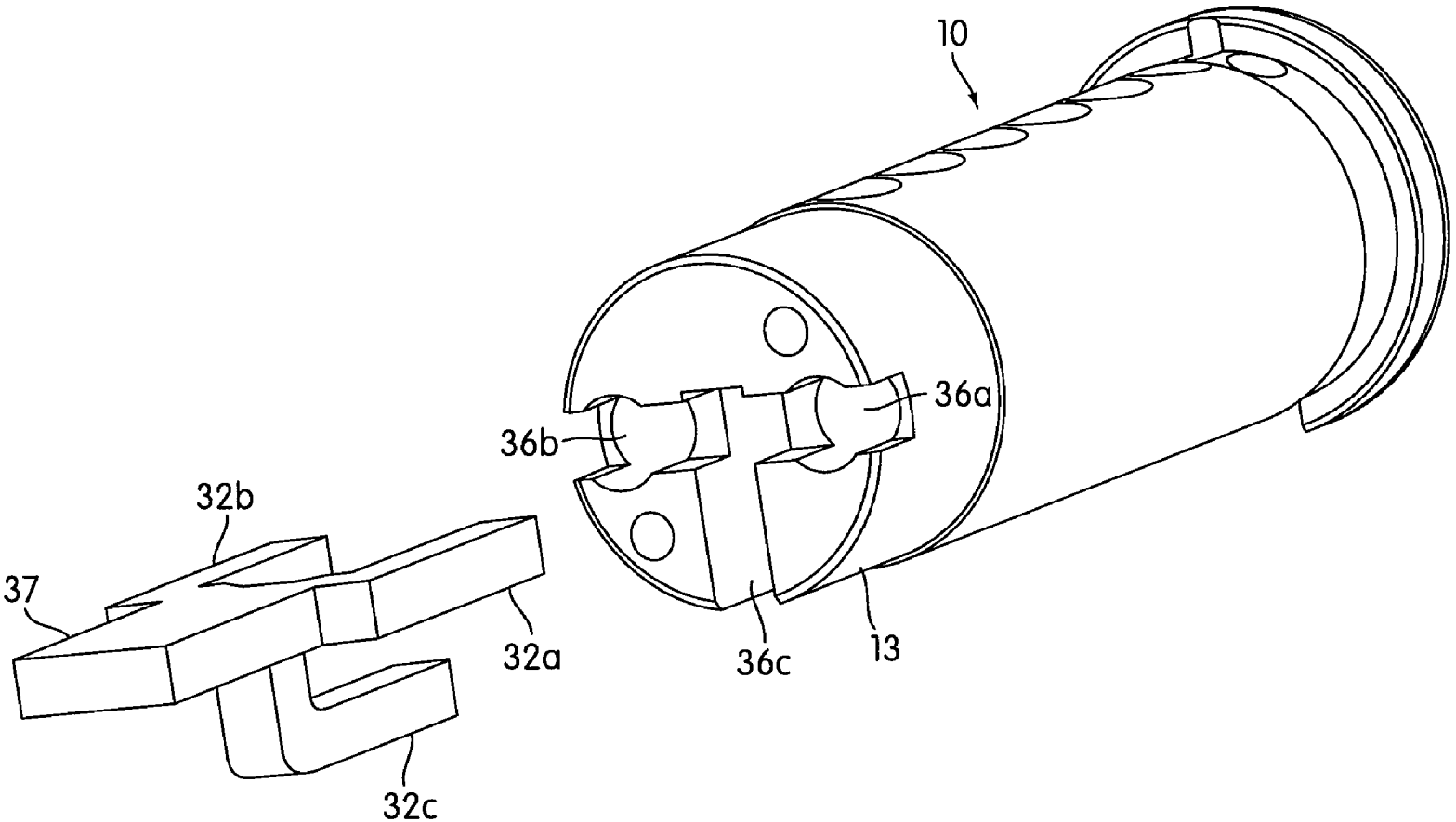
FIG. 10 is an exploded perspective view of a portion of an alternative embodiment of a cylinder lock assembly including a cylinder plug and a tailpiece with three extended, anti-rotation legs that are insertable into corresponding off-center holes formed in the cylinder plug.

FIG. 10 is perspective view of a portion of an alternative embodiment of a cylinder lock assembly with three anti-rotation legs 32*a*, 32*b*, 32*c* extending from the tailpiece 37 and insertable into off-center holes 36*a*, 36*b*, 36*c* formed in the cylinder plug 10. Hole 36*c* is an extension of the keyway (reference number 26 in FIG. 1). So that the third anti-rotation leg 32*c* does not interfere with a key inserted into the keyway, it may be necessary to elongate the plug 10 (and thus elongate the keyway), for example, by forming the plug from a longer piece of cylindrical stock or by adding an extension piece 13 to a conventional-length plug. Extension piece 13 may, for example, be secured to the plug 10 by screw or other suitable fastener elements.

Figure 11:
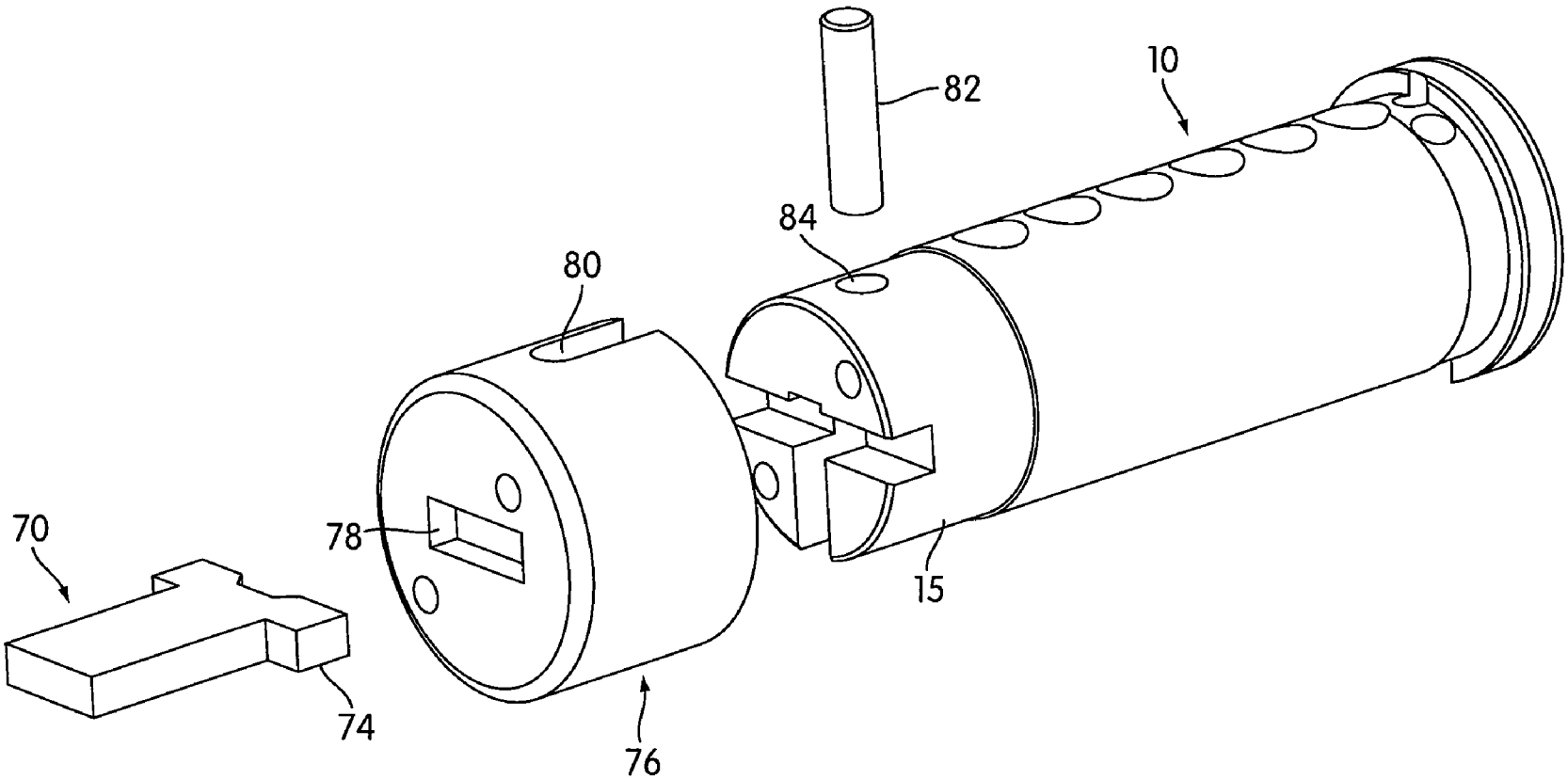
FIG. 11 is an exploded perspective view of a portion of an alternative embodiment of a cylinder lock assembly including a cylinder plug, a tailpiece, a tailpiece retainer cap, and an anti-rotation pin that extends from the cylinder plug into an opening formed in the tailpiece retainer cap.

FIG. 11 is perspective view of a portion of an alternative embodiment of a cylinder lock assembly including a cylinder plug 10, a tailpiece 70, a tailpiece retainer cap 76, and an anti-rotation pin 82 that extends from the cylinder plug 10 into an opening 80 formed in the tailpiece retainer cap 76. A rectangular tailpiece opening 78 is formed in the retainer cap 76. Tailpiece 70 extends through the opening 78 from inside the cap 76, and shoulders 74 formed on the tailpiece 70 prevent the tailpiece from passing completely through the opening 78. Retainer cap 76 fits over the end of the cylinder plug 10 and is secured to the plug 10 by mechanical fasteners (e.g., screws) or by press fit or other suitable means. So that the retainer cap 76 does not interfere with any of the tumbler holes, it may be necessary to elongate the plug 10, for example by forming the plug from a longer piece of cylindrical stock or by adding an extension piece 15 to a conventional-length plug. Extension piece 15 may, for example, be secured to the plug 10 by screw or other suitable fastener elements. The assembly includes a structural interface rotationally coupling the retainer cap 76 to the plug 10 to prevent the tailpiece 70 and the retainer cap 76 from rotating independently of the plug 10. In the embodiment of FIG. 11, the structural interface is provided by the anti-rotation pin 82 inserted into a radially-oriented hole 84 formed near the end of the plug 10. When the cap 76 is installed onto the end of the plug 10, pin 82 extends into the opening 80 formed in the cap 76. In the illustrated embodiment, opening 80 is a slot formed in the side wall of the cap 76 that extends to the end of the cap, but opening 80 may alternatively be a hole formed through the sidewall of the cap 76. When the retainer cap 76 is unconnected to the plug 10, the anti-rotation pin 82 extending through the opening 80 will prevent the cap 76 and the tailpiece 70 from rotating independently of the plug 10.

As an alternative to the anti-rotation pin 82 shown in FIG. 11, the structural interface between the retainer cap 76 and the cylinder plug 10 may be provided by a radial fin or other projection extending from the cylinder into the opening 80 formed in the cap 76. Furthermore, the assembly may include more than one pin, fin, or other projection extending from the plug and engageable with a corresponding opening formed in the cap.

Figure 12:
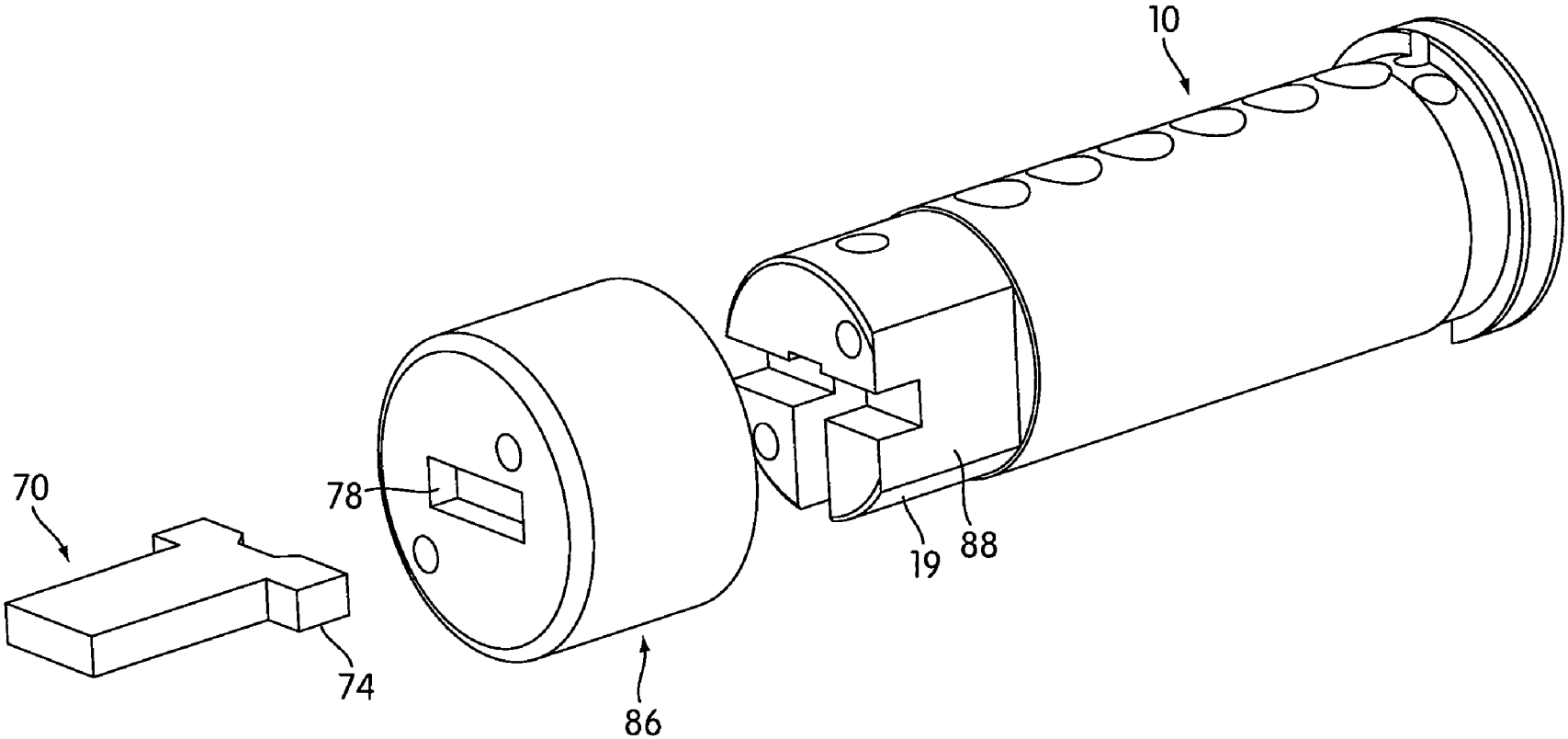
FIG. 12 is an exploded perspective view of a portion of an alternative embodiment of a cylinder lock assembly including a cylinder plug, a tailpiece, a tailpiece retainer cap, and an anti-rotation surface formed on the cylinder plug that engages a mating surface within the tailpiece retainer cap.

FIG. 12 is an exploded perspective view of a portion of an alternative embodiment of a cylinder lock assembly including a cylinder plug 10, a tailpiece 70, and a tailpiece retainer cap 86. In the embodiment of FIG. 12, the structural interface rotationally coupling the retainer cap 86 to the plug 10 is a flattened surface 88 formed in an extended portion 19 of the plug 10 which engages a mating flattened surface (not shown) formed in the interior of the cap 86. Engagement of the surface 88 with a mating surface within the cap 86 will prevent the cap from rotating independently of the cylinder plug 10. The assembly may include one or more additional flattened surfaces formed on the cylinder plug 10 which engage one or more corresponding mating surfaces formed in the interior of the cap.

Alternative structural interfaces for rotationally coupling the retainer cap to the plug may include mating grooves and ridges formed on the retainer cap and the cylinder plug or any other structural feature that will prevent the retainer cap from rotating independently of the cylinder plug.

Thus, a number of preferred embodiments have been fully described above with reference to the drawing figures. Other details of the embodiments of the invention should be readily apparent to one skilled in the art from the drawings. Although the invention has been described based upon these preferred embodiments, it would be apparent to those skilled in the art that certain modifications, variations, and alternative constructions would be apparent, while remaining within the spirit and scope of the invention.

We claim:

1. A cylinder lock assembly comprising:

a cylinder plug that is rotatable about its longitudinal axis, the cylinder plug having a front end and a rear end;

one or more tumbler shafts arranged radially within said cylinder plug;

a tailpiece adapted to operatively couple said cylinder plug to a deadbolt or door latch actuator and configured so as to be rotatable with the cylinder plug about the longitudinal axis when the tailpiece is connected to the cylinder plug;

a tailpiece connector adapted to connect said tailpiece with said cylinder plug, wherein the tailpiece connector comprises a tailpiece retainer plate coupled to the tailpiece and at least one fastener element extending through a fastener hole formed through the tailpiece retainer plate and into a fastener-receiving hole formed in the cylinder plug; and a coupling element rotationally coupling the tailpiece to the cylinder plug and comprising an anti-rotation element extending axially into the rear end of the cylinder plug at a location offset from the longitudinal axis of the cylinder plug, wherein said anti-rotation element extends axially toward the front end of the cylinder plug and beyond a tumbler shaft disposed closest to the rear end of the cylinder plug so as to prevent the tailpiece from rotating about the longitudinal axis independently of the cylinder plug when said fastener element is altered so that the tailpiece is not connected to the cylinder plug.

2. The cylinder lock assembly of claim 1, wherein the anti-rotation element extends into at least one axially-extending hole formed in the cylinder plug at the location offset from the longitudinal axis of the cylinder plug.

3. The cylinder lock assembly of claim 2, wherein the anti-rotation element comprises at least one axially-extending leg.

4. The cylinder lock assembly of claim 3, comprising two axially-extending legs.

5. The cylinder lock assembly of claim 3, comprising three axially-extending legs.

6. The cylinder lock assembly of claim 3, wherein the at least one axially-extending leg has a circular cross-sectional shape.

7. The cylinder lock assembly of claim 3, wherein the at least one axially-extending leg has a rectangular cross-sectional shape.

8. The cylinder lock assembly of claim 1, wherein the anti-rotation element extends into an axially-extending groove formed in the outer surface of the cylinder plug.

9. The cylinder lock assembly of claim 8, wherein the groove is rectangular in shape.

10. The cylinder lock assembly of claim 1, wherein the tailpiece and the anti-rotation element comprise a single, integrally-formed piece.

11. The cylinder lock assembly of claim 1, wherein the tailpiece and the anti-rotation element comprise separate pieces.

12. The cylinder lock assembly of claim 1, wherein the anti-rotation element and the tailpiece retainer plate comprise separate pieces.

13. The cylinder lock assembly of claim 12, wherein the anti-rotation element comprises an anti-rotation pin extending through the tailpiece retainer plate and axially into the cylinder plug at the location offset from the longitudinal axis of the cylinder plug.

14. The cylinder lock assembly of claim 1, wherein the tailpiece has a tailpiece shoulder configured to engage with a slot in the rear end of the cylinder plug, thereby configuring the tailpiece to rotate with the cylinder plug when the tailpiece is connected to the cylinder plug.

15. In a cylinder lock assembly comprising a cylinder plug that is rotatable about its longitudinal axis and having a front end and a rear end and one or more tumbler shafts arranged radially within said cylinder plug, and tailpiece connected to the cylinder plug by a tailpiece connector and adapted to operatively couple the cylinder plug to a deadbolt or door latch actuator, said tailpiece connector including a tailpiece retainer plate and a fastener element securing the tailpiece to said cylinder plug, a method for rotationally coupling the tailpiece to the cylinder plug which comprises providing a coupling element comprising an anti-rotation element that is fixed with respect to the tailpiece and extends axially into the rear end of the cylinder plug at a location offset from the longitudinal axis of the cylinder plug wherein said anti-rotation element extends axially toward the front end of the cylinder plug and beyond a tumbler shaft disposed closest to the rear end of the cylinder plug, thereby preventing the tailpiece from rotating about the longitudinal axis independently of the cylinder plug when said fastener element is altered so that the tailpiece is not connected to the cylinder plug.

16. The method of claim 15, further comprising forming at least one axially-extending hole in the cylinder plug at least one location offset from the longitudinal axis of the cylinder plug for receiving the anti-rotation element.

17. The method of claim 15, further comprising forming at least one axially-extending groove in the surface of the cylinder plug for receiving the coupling element.

18. The method of claim 15, wherein the anti-rotation element comprises at least one anti-rotation leg extending from the tailpiece.

19. The method of claim 15, wherein the coupling element comprises a pin extending through the tailpiece retainer plate and axially into the cylinder plug at the location offset from the longitudinal axis of the cylinder plug.

20. The method of claim 15, wherein the tailpiece has a tailpiece shoulder configured to engage with a slot in the rear end of the cylinder plug, thereby configuring the tailpiece to rotate with the cylinder plug when the tailpiece is connected to the cylinder plug.

21. A method for modifying a lock assembly, including a tailpiece connected by a tailpiece connector to a cylinder plug that is rotatable about its longitudinal axis and having a front end and a rear end, said tailpiece connector including a tailpiece retainer plate and a fastener element securing the tailpiece to said cylinder plug, and one or more tumbler pins disposed within corresponding tumbler shafts arranged radially within said cylinder plug, to rotationally couple the tailpiece to the cylinder plug comprising:

forming at least one axial hole in the cylinder plug that extends axially toward the front end of the cylinder plug and beyond a tumbler shaft disposed closest to the rear end of the cylinder plug, each axial hole being formed at a location offset from the longitudinal axis;

securing at least one projection with respect to the tailpiece with an orientation that is generally parallel to the longitudinal axis of the cylinder plug, each projection being secured at a location that is aligned with a corresponding axial hole formed in the cylinder plug; and inserting each projection into the corresponding axial hole, said projection extending axially toward the front end of the cylinder plug and beyond a tumbler shaft disposed closest to the rear end of the cylinder plug so as to prevent the tailpiece from rotating about the longitudinal axis independently of the cylinder plug when said fastener element is altered so that the tailpiece is not connected to the cylinder plug.

22. The method of claim 21, wherein the projection comprises a pin, and the step of securing the projection comprises forming a hole in the tailpiece retainer plate and inserting the pin through the hole.

23. The method of claim 21, wherein the tailpiece has a tailpiece shoulder configured to engage with a slot in the rear end of the cylinder plug, thereby configuring the tailpiece to rotate with the cylinder plug when the tailpiece is connected to the cylinder plug.

* * * * *